US010544771B2

(12) United States Patent
Caceres

(10) Patent No.: US 10,544,771 B2
(45) Date of Patent: Jan. 28, 2020

(54) FUEL INJECTOR BODY WITH COUNTERBORE INSERT

(71) Applicant: Caterpillar Inc., Peoria, IL (US)

(72) Inventor: Diego Caceres, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 210 days.

(21) Appl. No.: 15/622,947

(22) Filed: Jun. 14, 2017

(65) Prior Publication Data

US 2018/0363610 A1 Dec. 20, 2018

(51) Int. Cl.

| | |
|---|---|
| ***F02M 61/04*** | (2006.01) |
| ***F02M 61/08*** | (2006.01) |
| ***F02M 57/02*** | (2006.01) |
| ***F02M 45/00*** | (2006.01) |
| ***F02M 63/00*** | (2006.01) |

(52) U.S. Cl.

CPC ..... *F02M 61/042* (2013.01); *F02M 57/02* (2013.01); *F02M 57/026* (2013.01); *F02M 61/08* (2013.01); *F02M 63/0054* (2013.01); *F02M 2200/8061* (2013.01); *F02M 2547/008* (2013.01)

(58) Field of Classification Search

CPC ..... F02M 61/042; F02M 61/08; F02M 57/02; F02M 57/026; F02M 63/0054; F02M 63/0029; F02M 2200/8061; F02M 2200/8092; F02M 3547/008

USPC ..... 239/584; 123/446

See application file for complete search history.

(56) References Cited

U.S. PATENT DOCUMENTS 3,190,561 A * 6/1965 Thomson ..... F02M 57/02 239/90
3,481,542 A * 12/1969 Huber ..... F02M 47/027 239/71
4,684,067 A * 8/1987 Cotter ..... F02M 45/083 123/467
4,938,193 A * 7/1990 Raufeisen ..... B25B 27/023 123/467
5,669,355 A * 9/1997 Gibson ..... F02G 5/00 123/446
5,682,858 A * 11/1997 Chen ..... F02M 45/04 123/467
5,833,146 A * 11/1998 Hefler ..... F02M 47/027 239/533.8
5,975,139 A * 11/1999 Carroll ..... F02M 47/027 137/625.6

(Continued)

FOREIGN PATENT DOCUMENTS

WO 0020752 4/2000

*Primary Examiner* — Steven J Ganey
*Assistant Examiner* — Joseph A Greenlund
(74) *Attorney, Agent, or Firm* — Law Office of Kurt J. Fugman LLC

(57) ABSTRACT

An insert for use with a fuel injector comprises a shaft including a substantially cylindrical configuration defining a shaft cylindrical axis, a shaft radial direction, and a shaft diameter; and a head including a substantially cylindrical configuration defining a head cylindrical axis, a head radial direction, and a head diameter. The shaft and head may be attached to each other, the shaft cylindrical axis and the head cylindrical axis may be parallel to each other, the head diameter may be greater than the shaft diameter, and the shaft cylindrical axis may be spaced away from the head cylindrical axis.

6 Claims, 7 Drawing Sheets

(56) References Cited

U.S. PATENT DOCUMENTS 6,067,955 A * 5/2000 Boecking ..... F02M 45/04 123/299
6,085,992 A * 7/2000 Chockley ..... F02M 45/06 239/533.8
6,142,394 A * 11/2000 Hefler ..... F02M 57/025 239/533.2
6,237,857 B1 * 5/2001 Ausman ..... A01M 7/00 137/625.64
6,354,270 B1 * 3/2002 Shafer ..... F02M 37/06 123/446
6,360,721 B1 * 3/2002 Schuricht ..... F02M 47/027 123/446
6,425,375 B1 * 7/2002 Hefler ..... F02M 47/04 123/446
6,454,189 B1 * 9/2002 Krishnamurthy .... F02M 47/027 239/533.11
6,530,363 B1 * 3/2003 Blass ..... F02M 39/00 123/446
6,532,943 B1 * 3/2003 Yudanov ..... F02M 47/02 123/446
6,647,964 B1 * 11/2003 Schuricht ..... F02M 45/08 123/446
6,655,602 B2 * 12/2003 Shafer ..... F02M 47/043 123/446
6,663,014 B1 * 12/2003 Depayva ..... F02M 47/027 239/88
6,691,935 B1 * 2/2004 Potz ..... F02M 45/00 239/124
6,830,202 B2 * 12/2004 Coldren ..... F02M 45/063 239/533.2
7,510,127 B2 * 3/2009 Haji ..... F02M 57/025 239/88
7,673,817 B2 * 3/2010 Brauneis ..... F02M 55/002 123/470
7,735,751 B2 * 6/2010 Ehlert ..... F02M 47/027 123/445
7,744,015 B2 * 6/2010 McNichols ..... F02M 47/027 123/445
7,926,737 B2 * 4/2011 Stoecklein ..... F02M 47/02 123/496
9,212,639 B2 * 12/2015 Kim ..... F02M 43/04
2002/0060253 A1 * 5/2002 Boecking ..... F02M 63/0003 239/89
2002/0070285 A1 * 6/2002 Cotton ..... F02M 47/027 239/89
2002/0073841 A1 * 6/2002 Desai ..... F02M 57/025 92/172
2002/0148444 A1 * 10/2002 Hefler ..... F02G 5/00 123/446
2003/0101967 A1 * 6/2003 Forck ..... F02M 47/027 123/446
2004/0000597 A1 1/2004 Depayva et al.
2004/0021003 A1 * 2/2004 Hefler ..... F02M 55/004 239/88
2004/0021013 A1 * 2/2004 Lawrence ..... F02M 57/025 239/533.12
2009/0224079 A1 9/2009 Johnson et al.
2009/0229571 A1 * 9/2009 Vahle ..... F02M 59/105 123/445
2010/0096473 A1 * 4/2010 Coldren ..... F02M 45/08 239/90
2010/0176222 A1 * 7/2010 Straub ..... F02M 47/027 239/584
2011/0272499 A1 * 11/2011 Venkataraghavan ..... F02M 47/027 239/584
2013/0015274 A1 * 1/2013 Kang ..... F02M 59/26 239/584
2013/0020412 A1 * 1/2013 Teerman ..... F02M 57/026 239/533.2
2013/0221136 A1 * 8/2013 Hansen ..... F02M 55/008 239/562
2014/0174405 A1 * 6/2014 Adachi ..... F02M 51/06 123/472
2018/0363610 A1 * 12/2018 Caceres ..... F02M 61/042

* cited by examiner

FUEL INJECTOR BODY WITH COUNTERBORE INSERT

TECHNICAL FIELD

The present disclosure relates generally to fuel injectors that use fuel injector bodies with an injection rate shaping orifice. More specifically, the present disclosure relates to a method of remanufacturing or refurbishing such fuel injector bodies so that the injection rate shaping orifice may be modified, replaced or repaired.

BACKGROUND

Fuel injectors routinely use pistons (sometimes referred to as intensifier pistons) that operatively communicate with injection rate shaping orifices. The part of the fuel injector assembly, such as a fuel injector body, which defines such an injection rate shaping orifice may be subject to erosion or damage for a host of reasons. For example, a valve member of the fuel injector may impact the area of the injection rate shaping orifice or dirty hydraulic oil may act at the surface defining the injection rate shaping orifice at a high pressure. This may create cavitation that causes this area to wear. As a result of either scenario, the dimensions associated with the injection rate shaping orifice may change to the point where these dimensions are out of tolerance. Of course, there is an associated detriment to the intended performance of the injection rate shaping orifice at this point.

Once this situation is determined to exist, the fuel injector as a whole or the fuel injector body may need to be replaced. However, replacing the fuel injector as a whole or even just the fuel injector body may be time consuming and costly. Furthermore, in some instances, it may be desirable to alter the original geometry of the injection rate shaping orifice for various reasons such as to improve fuel economy, reduce emissions or for various other performance related reasons.

Accordingly, it is desirable to develop a method and apparatus that may allow the user of a fuel injector to remanufacture, refurbish or otherwise replace the injection rate shaping orifice of a fuel injector in a reliable and economic manner.

SUMMARY OF THE DISCLOSURE

An insert for use with a fuel injector according to an embodiment of the present disclosure may be provided. The insert may comprise a shaft including a substantially cylindrical configuration defining a shaft cylindrical axis, a shaft radial direction, and a shaft diameter; and a head including a substantially cylindrical configuration defining a head cylindrical axis, a head radial direction, and a head diameter. The shaft and head may be attached to each other, the shaft cylindrical axis and the head cylindrical axis may be parallel to each other, the head diameter may be greater than the shaft diameter, and the shaft cylindrical axis may be spaced away from the head cylindrical axis.

A fuel injector assembly according to an embodiment of the present disclosure may be provided. The fuel injector assembly may comprise a fuel injector component that defines a pressurized fuel chamber, a check valve assembly in fluid communication with the pressurized fuel chamber, a plunger disposed in the pressurized fuel chamber, and a fuel injector body. The fuel injector body may include a substantially cylindrical body defining a longitudinal axis, a radial direction, a first end along the longitudinal axis, a second end along the longitudinal axis, and may also define a piston receiving cavity that extends longitudinally from the first end toward the second end terminating short thereof. In addition, the fuel injector body may define a counterbore extending longitudinally from the second end toward the first end and defining a large diameter cylindrical portion proximate the second end, an intermediate diameter cylindrical portion extending longitudinally from the large diameter cylindrical portion toward the first end, and a small diameter cylindrical portion extending longitudinally from the intermediate diameter cylindrical portion toward the first end. Also, there may be a first bore extending from the small diameter cylindrical portion to the piston receiving cavity.

A method for remanufacturing a fuel injector body or designing an insert for use with a fuel injector body of a fuel injector assembly according to an embodiment of the present disclosure is provided. The method may comprise determining at least one of the following: a first minimum desirable distance from a bore of a fuel injector body to a small diameter cylindrical portion of a counterbore of the fuel injector body, and a second minimum desirable distance from a bore of a fuel injector body to a larger diameter cylindrical portion of the counterbore of the fuel injector body. The method may further comprise designing the configuration of the counterbore so that either the first or second minimum distances are maintained.

DETAILED DESCRIPTION

Figure 1:
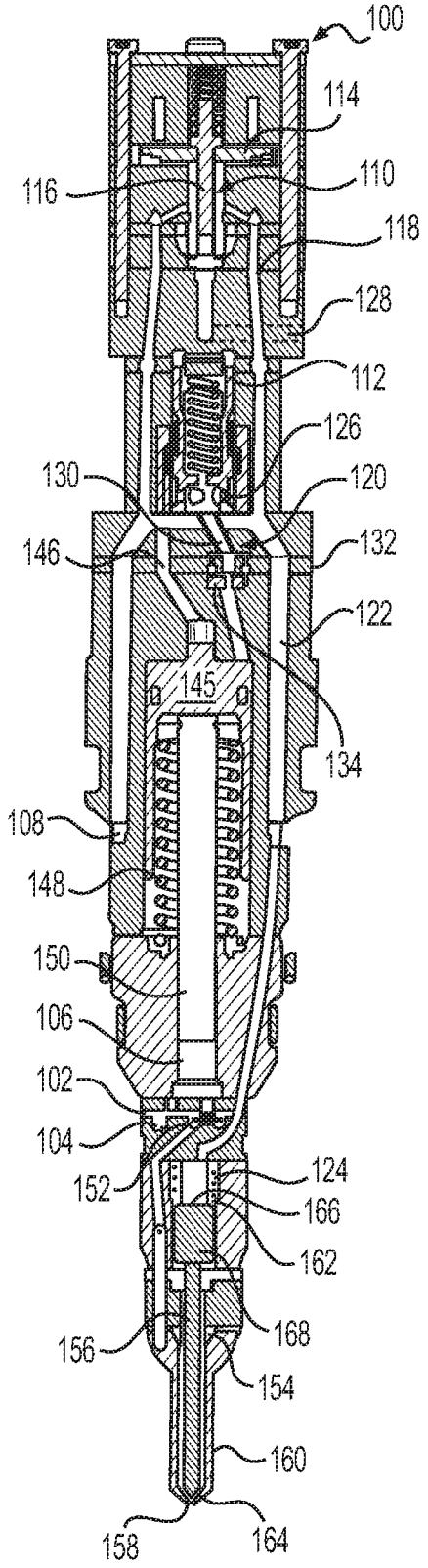
FIG. 1 is a cut-away side view of a fuel injector assembly that may use a fuel injector body with an injection rate shaping insert according to various embodiments of the present disclosure, illustrating the general operation of the fuel injector assembly.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A method for modifying or manufacturing an insert, a fuel injector body with a counterbore for receiving the insert, the resulting fuel injector body or insert, or other similar component (thus fuel injector body is to be interpreted broadly to cover any such component) of a fuel injector assembly and the fuel injector assembly that may use such components according to various embodiments of the present disclosure will now be described. While the application discussed herein is primarily a hydraulic electronic unit injector, so-called as the injection is powered hydraulically and controlled electronically, it is to be understood that in other embodiments the fuel injector that uses the method, insert, or other fuel injector body, etc. described herein may be powered to inject in another manner, such as mechanically, or controlled in another manner, etc. Similarly, the type of fuel injected by the injector may be varied and includes diesel fuel, gasoline, etc. Accordingly, the applications of the embodiments discussed herein are applicable to a host of engine types and to a host of machines driven by such engines.

Figure 2:
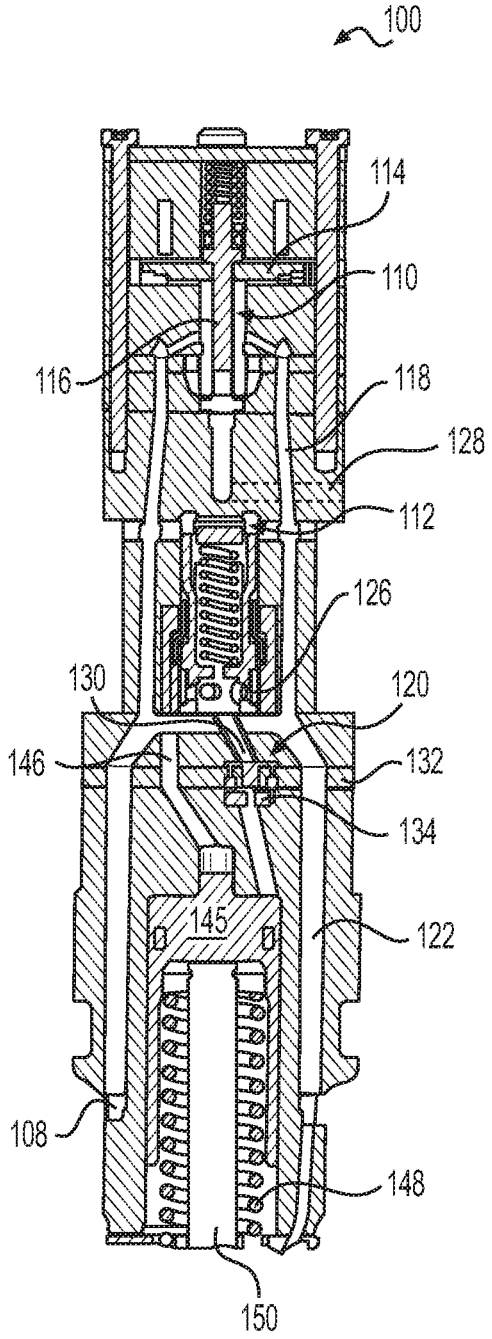
FIG. 2 is an enlarged view of the fuel injector assembly of FIG. 1 showing more clearly how the damper plate or member houses part of the rate shape orifice and how the fuel injector body houses the valve member or plate.
Figure 3:
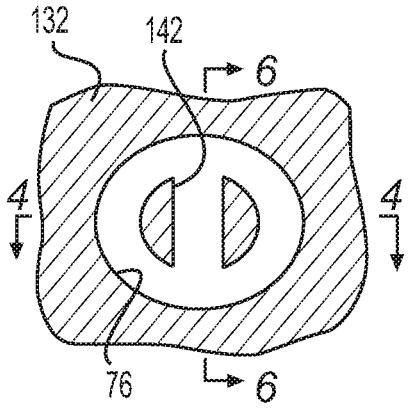
FIG. 3 is a bottom view of a damper plate or similar component according to an embodiment of the present disclosure similar to that disclosed in FIG. 2.

FIGS. 1 and 2 are diagrammatic illustrations of a hydraulically actuated electronically controlled unit injector (herein after referred to as fuel injector assembly 100). Fuel enters the fuel injector assembly 100 through fuel inlet passage 102, passes ball check valve 104 and enters fuel pressurization chamber 106 (may also be referred to as a pressurized fuel chamber in a more general sense in applications such as those associated with a common rail system, etc.). High pressure actuation fluid enters fuel injector assembly 100 through actuation fluid inlet passage 108. Actuation fluid then travels to control valve 110 and spool valve 112.

Control valve 110 controls the overall operation of the fuel injector assembly 100 and operates as a pilot valve for the spool valve 112. Control valve 110 includes an armature 114 and a seated pin 116. A solenoid (not shown) in control valve 110 controls movement of the armature 114 and therefore the position of the seated pin 116. In a first upper position, seated pin 116 allows high pressure actuation fluid to travel through upper check passage 118, past flow control valve 120 and through lower check passage 122 to check control cavity 124. When seated pin 116 is in the first upper position, high pressure actuation fluid also travels through upper check passage 118 to spool passage 126 to balance spool valve 112 in its first position. When seated pin 116 is in its second lower position, high pressure actuation fluid from actuation fluid inlet passage is blocked and upper check passage 118, lower check passage 122, check control cavity 124 and spool passage 126 are open to low pressure drain 128.

Flow control valve 120 comprises a flow orifice 130, located in a damper plate or damper member 132, and a valve member 134 located in the fuel injector body 200. Flow control valve 120 allows for different flow rates depending on the direction of the flow. When seated pin 116 is in the first upper position, allowing high pressure actuation fluid into check control cavity 124, the actuation fluid travels through flow orifice 130 but valve member 134 is in a closed position (see FIG. 1). This results in a slower fill rate of check control cavity 124. When seated pin 116 is in its second lower position, opening check control cavity 124 to low pressure drain 128, flow travels through flow orifice 130 and also past the valve member 134, due to the valve member coming of its seat (see FIG. 4). This allows a faster venting flow rate than the filling flow rate.

Figure 4:
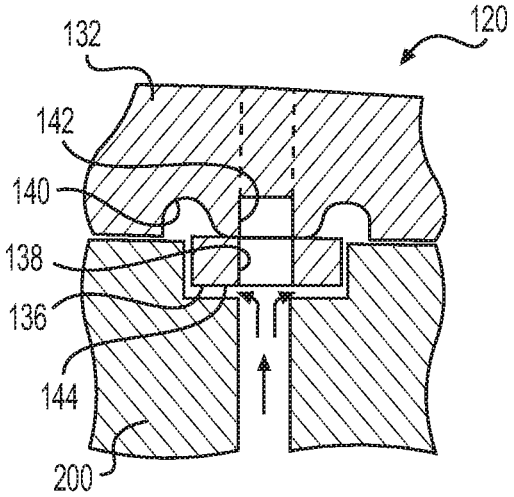
FIG. 4 is a front cross-sectional view of a flow control valve of the embodiment of FIG. 3 showing upward flow through the rate shaping orifice of a valve member.
Figure 5:
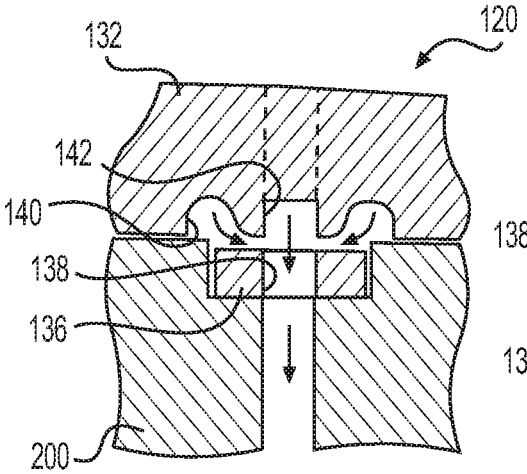
FIG. 5 is a front cross-sectional view of the flow control valve of FIG. 4 showing downward flow through the rate shaping orifice of the valve member.
Figure 6:
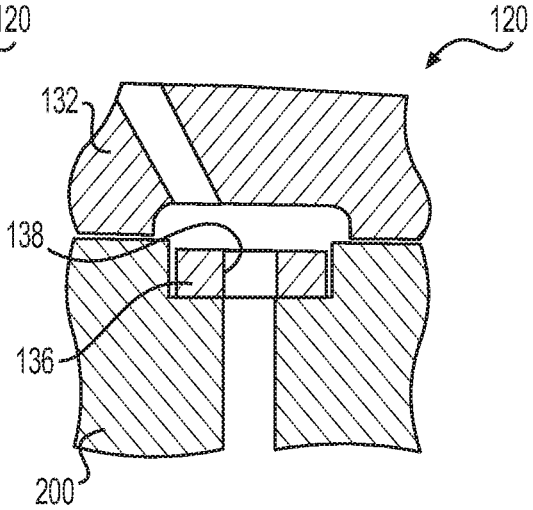
FIG. 6 is a side cross-sectional view of the flow control valve of FIG. 4.

The key is having different flow rates depending on the direction of the flow. For example, in FIGS. 3 thru 6, the flow control valve 120 regulates the flow between upper check passage 118 and lower check passage 122. In this embodiment, flow control valve 120 includes rate shaping orifice plate 136 and grooved damper member 132. Rate shaping orifice plate 136 is a circular disk that defines rate shaping orifice 138 through the center of plate 136. Damper member 132 defines a circular annulus 140 and a center passage 142 that is in fluid communication with the circular annulus 140. When high pressure fluid is moving from upper check passage 118 to lower check passage 122, as illustrated in FIG. 4, rate shaping orifice plate 136 is pushed down, forming a seal with the fuel injector body 200 and only allowing flow through rate shaping orifice 138. When fluid is all moving from lower check passage 122 to upper check passage 118, as illustrated in FIG. 4, rate shaping orifice plate 136 is moved up, away from the fuel injector body 200, allowing flow through rate shaping orifice 138 and around rate shaping orifice plate 136 in annular plate passage 144. This allows a high flow rate in the second direction.

Referring back to FIG. 1, when seated pin 116 is moved to its second lower position, the spool passage 126 is open to low pressure drain 128, which unbalances spool valve 112 and allows high pressure actuation fluid to travel through piston passage 146 and act upon intensifier piston 145. When high pressure actuation fluid acts upon intensifier piston 145, intensifier piston 145 moves downward, against the force of piston spring 148, causing plunger 150 to move downward and pressurize fuel in fuel pressurization chamber 106. Fuel in fuel pressurization chamber 106 is pressurized to injection pressure and is directed through high pressure fuel passage 152 and into fuel cavity 154.

Check valve 156 is located in the nozzle assembly of the fuel injector assembly and controls the flow of fuel through orifices 158, in nozzle tip 160[60], in to the combustion chamber (not shown). Check valve 156 is biased in the closed position by check spring 162. High pressure fuel in fuel cavity 154 acts on an opening surface 164 of check valve 156 and pushes it upwards, against check spring 162, into the open position, allowing injection through orifice 158. Check valve opening and closing is also hydraulically controlled by check control cavity 124. When high pressure actuation fluid is present in check control cavity 124, it helps keep check valve 156 closed even when high pressure fuel is present in fuel cavity 154. The high pressure actuation fluid acts upon a closing surface 166 of check piston 168 and hydraulically offsets and, in fact overcomes, the pressure from the high pressure fuel in fuel cavity 154. The high pressure actuation fluid helps close check valve 156 in combination with check valve spring 162. Injection occurs when check control cavity 124 is opened to low pressure drain 128, leaving the pressurized fuel to overcome only the check valve spring's 162 force. By controlling the high pressure actuation fluid in check control cavity 124, injection timing and duration can be more accurately controlled.

Controlling injection pressure and timing is very important to reducing emissions. In particular, it is necessary to control injection pressure at the end of injection. Conventional wisdom dictated that injection should be terminated as quickly as possible, such that a high injection pressure was terminated as quickly as possible in a "square" rate shape. However, it has been learned that slowing the end of injection, while decreasing injection pressure, is beneficial to reducing emissions. (Essentially having a decreasing ramp rate shape at the end of injection.)

As explained above, the fuel injector assembly 100 starts in a closed or no-injection state. Control valve 120 is in its first position providing high pressure actuation fluid to the control cavity 124. This insures that check valve 156 remains closed, preventing any fuel from entering the combustion chamber (not shown) through orifice 158. Control valve 120 also provides high pressure actuation fluid to spool passage 126, thereby biasing spool valve 126 in its first position, which prevents high pressure actuation fluid from acting on intensifier piston 145 and pressurizing fuel.

When injection is desired, control valve 120 is actuated causing seated pin 116 to move to its second position. This opens spool passage 126 to low pressure drain 128, allowing spool valve 112 to move to its second lower position. In its second lower position, spool valve 112 allows high pressure actuation fluid to act upon intensifier piston 145 which causes intensifier piston 145 and subsequently plunger 150 to move downward and pressurize fuel in fuel pressurization chamber 106. Pressurized fuel then moves to fuel cavity 154 where it acts on check valve 156, trying to push check 156 up, into the open position, so that injection can occur. When seated pin 116 is in the second position, check control cavity 124 is also opened to low pressure drain 128. This results in check spring 162 being the only thing that keeps check valve 156 closed; however, as fuel is pressurized, the force of the pressurized fuel overcomes the force of the check spring 162 and moves the check valve 156 to its open position.

Also, during the injection phase, it is important to properly vent the check control cavity 124. Depending on the desired timing, it may be necessary to vent check control cavity 124 quickly (possibly faster than fuel is pressurizing) to allow the fuel pressure to control injection timing (by increasing in pressure to overcome the force of check valve spring 162.) This quick flow rate is achieved by allowing actuation fluid to travel through flow control valve 120. Flow control valve 120 includes a flow orifice 130 and a valve member 134. When flow check control cavity 124 is open to drain, flow travels through flow orifice 130 and also opens the valve member 134, allowing additional flow and a rather quick flow rate to low pressure drain 128.

When end of injection is desired, control valve 110 is de-actuated and seated pin 116 is moved back to its first position. This results in high pressure actuation fluid traveling back in to spool passage 126 to bias spool valve 112 and move it back to its first position. Moving back to its first position, spool valve 112 stops letting high pressure actuation fluid act on intensifier piston 145, which stops fuel pressurization. Additionally, when the seated pin 116 moves back to its first position, high pressure actuation fluid is again directed through flow control valve 120 and back into check control cavity 124 to insure check closure. When actuation fluid travels through flow control valve 120 in this direction, flow again travels through flow orifice 130 but the actuation fluid closes the flow check valve 120. This results in a slower flow rate into the check control cavity 124 than the flow rate out of the check control cavity 124.

The size of the valve and its passages and orifices can be sized according to each injector's specific design. Those skilled in the art will understand that modeling and experimentation on valve sizes will achieve desired results. The present example has only illustrated a single injection event but multiple injections per engine cycle could be employed. Further, actuation fluid is preferably lubrication oil but could be any variety of other engine fluids, including fuel, coolant, or steering fluid. The present example also illustrates the use of the flow control valve in a hydraulically actuated electronically controlled unit injector; however, the flow control valve could be used in a variety of other injector types, including common rail systems, mechanical or other hydraulic devices.

Figure 7:
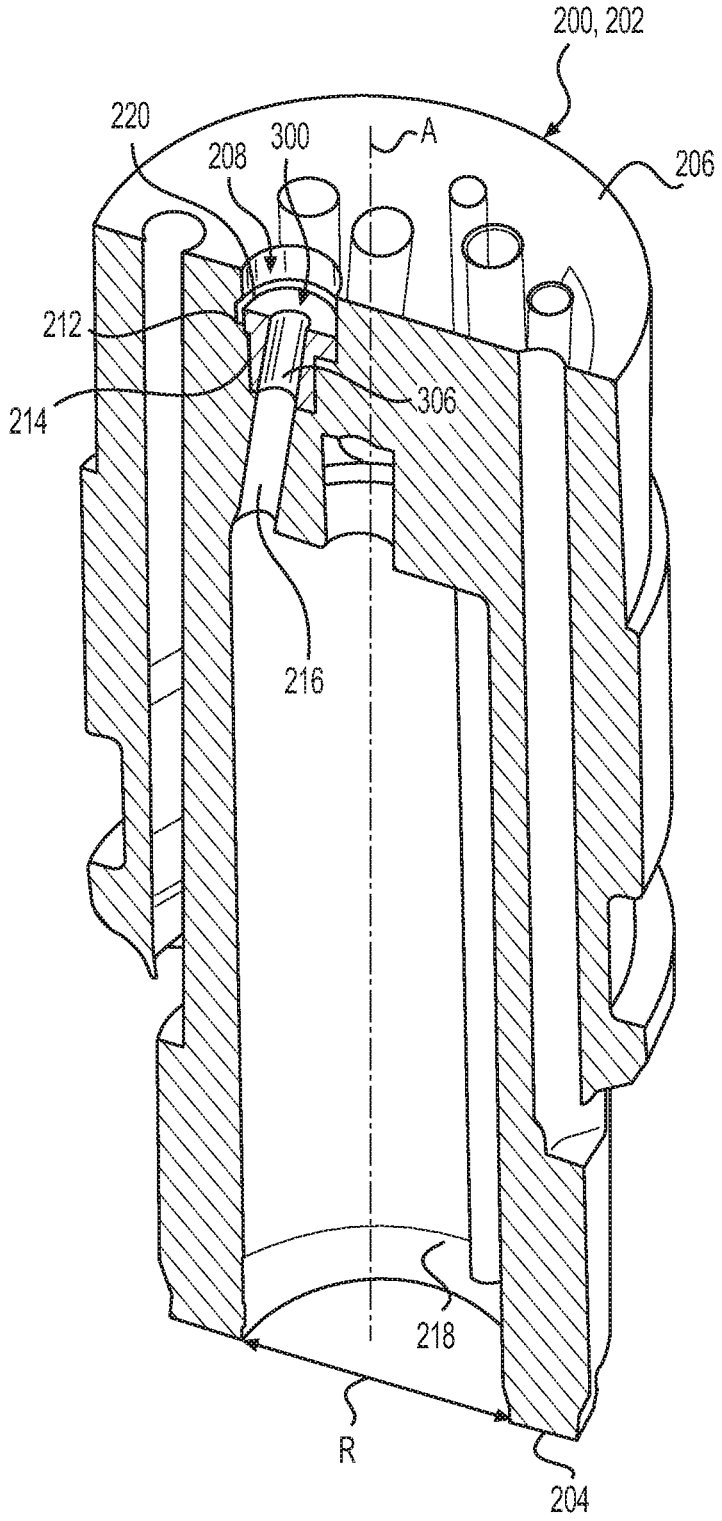
FIG. 7 is a partial perspective cut-away view of the fuel injector body removed from the fuel injector assembly of FIG. 1, showing the internal details of how the insert mates with the counterbore of the fuel injector body more clearly.
Figure 8:
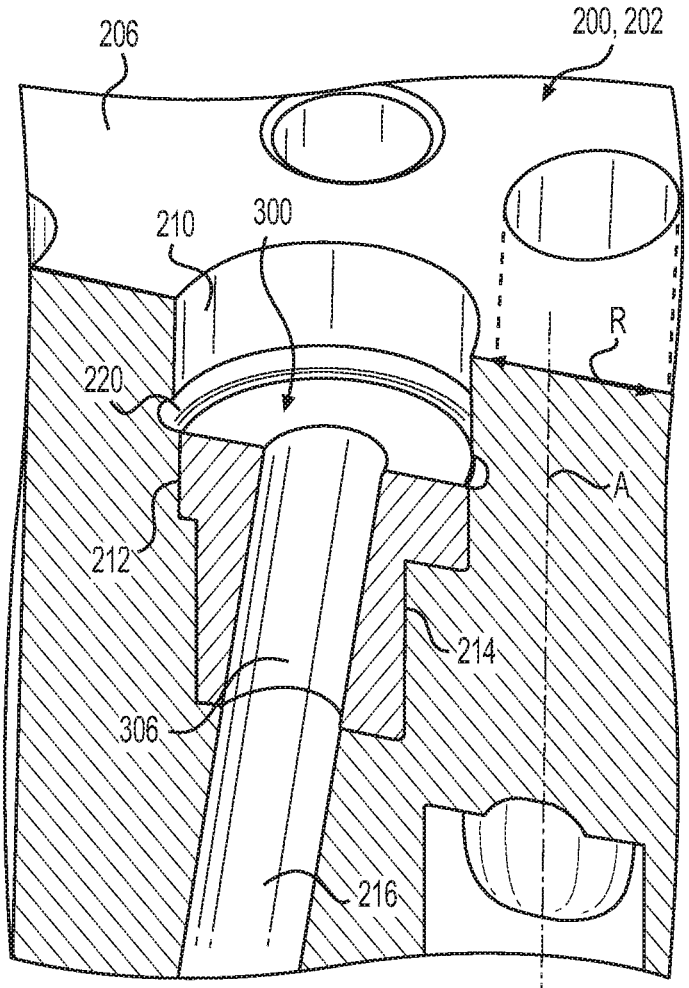
FIG. 8 is an enlarged view of the insert of FIG. 7 assembled into the counterbore of the fuel injector body.
Figure 12:
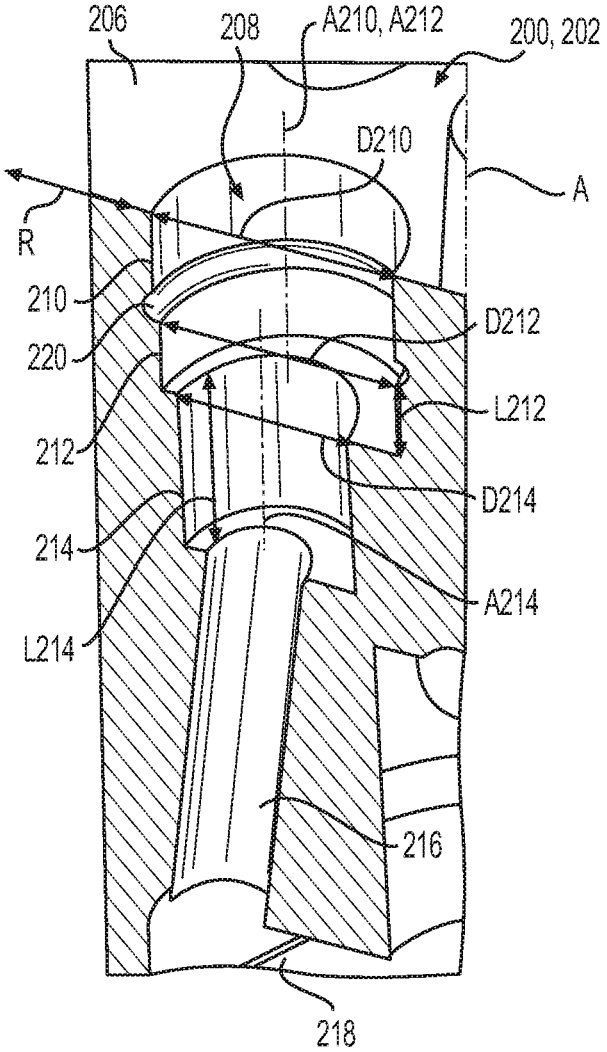
FIG. 12 is a perspective view of the fuel injector body of FIG. 7 with the insert removed, showing more clearly the geometry of the counterbore.

Looking now at FIGS. 7, 8 and 12, a fuel injector body 200 according to an embodiment of the present disclosure, such as may be used in the fuel injector assembly 100 of FIGS. 1 thru 6, is illustrated. Such a fuel injector body 200 may include a substantially cylindrical body 202 defining a longitudinal axis A, a radial direction R, a first end 204 along the longitudinal axis A, and a second end 206 along the longitudinal axis A. The fuel injector body 200 may also define a piston receiving cavity 218 that extends from the first end 204 toward the second end 206 terminating short thereof and a counterbore 208 extending longitudinally from the second end 206 toward the first end 204. This counterbore 208 may define a large diameter cylindrical portion 210 proximate the second end 206, an intermediate diameter cylindrical portion 212 extending longitudinally from the large diameter cylindrical portion 210 toward the first end 204, and a small diameter cylindrical portion 214 extending longitudinally from the intermediate diameter cylindrical portion 212 toward the first end 204, and a first bore 216 extending from the small diameter cylindrical portion 214 to the piston receiving cavity 218.

The counterbore 208 further defines a groove 220 disposed longitudinally between the large diameter cylindrical portion 210 and the intermediate diameter cylindrical portion 212. This groove 220 is configured to provide clearance so there is no corner interference between the valve member 134, such as a rate shaping orifice plate 136, and the counterbore 208. For this embodiment, the first bore 216 extends radially and longitudinally from the small diameter cylindrical portion 214 to the piston receiving cavity 218. These features may be differently configured or omitted in other embodiments.

Focusing now on FIG. 12, the large diameter cylindrical portion 210 defines a first diameter D210 and a first cylindrical axis A210, the intermediate diameter cylindrical portion 212 defines a second diameter D212 and a second cylindrical axis A212, and the small diameter cylindrical portion 214 defines a third diameter D214 and a third cylindrical axis A214. The first and second cylindrical axes A210, A212 are collinear and the third cylindrical axis A214 is spaced away from the first and second cylindrical axes, being parallel with those axes. The large diameter cylindrical portion 210 is configured to allow the valve member 134, such as a rate shaping orifice plate 136, to move up and down in this portion of the counterbore 208 as alluded to earlier herein.

Figure 13:
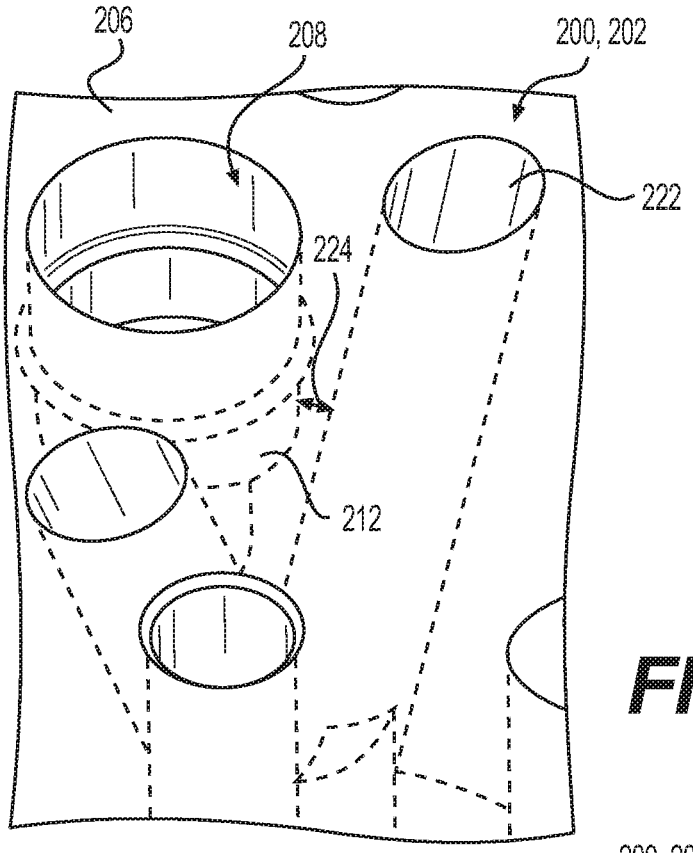
FIG. 13 is a perspective view of the counterbore of the fuel injector body, yielding a minimum distance between the intermediate diameter cylindrical portion of the counterbore and a high pressure bore of the fuel injector body.
Figure 14:
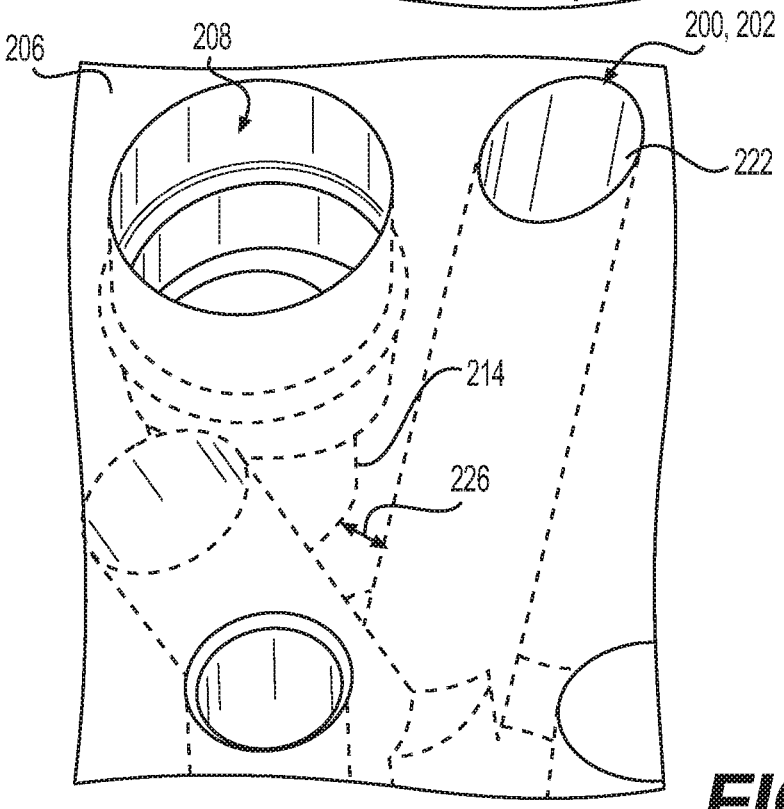
FIG. 14 is a perspective view of the counterbore of the fuel injector body, yielding a minimum distance between the small diameter cylindrical portion of the counterbore and a high pressure bore of the fuel injector body.
Figure 15:
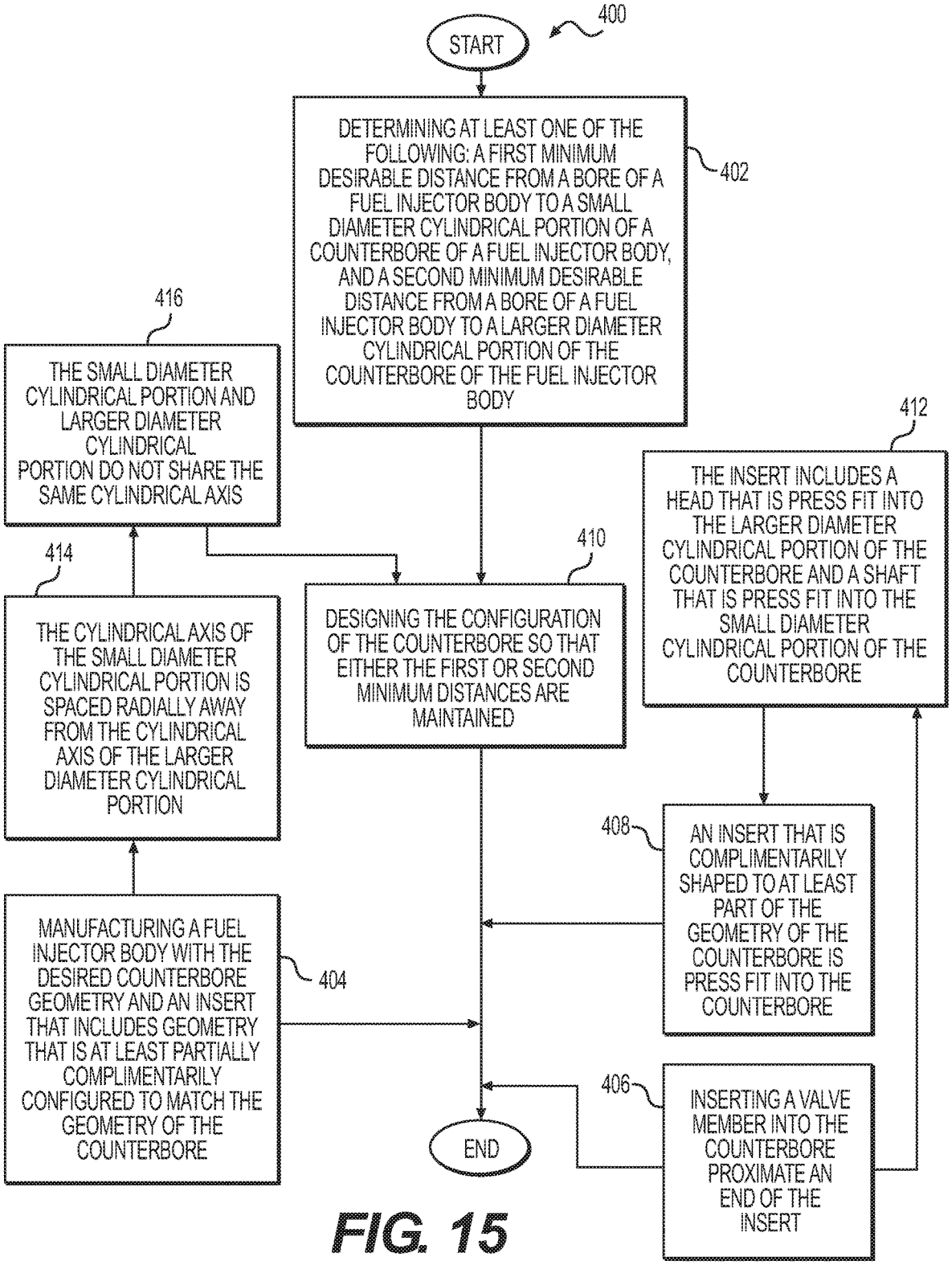
FIG. 15 is a flow chart containing a method for remanufacturing a fuel injector body or designing an insert for use with a fuel injector body according to an embodiment of the present disclosure.

Furthermore, as depicted in FIGS. 13 and 14, the fuel injector body 200 defines a second bore 222 (such as a high pressure bore) extending from the first end 204 toward the second end 206 and the first minimum distance 224 from the second bore 222 to the intermediate diameter cylindrical portion 212 of the counterbore 208 is at least 0.5 mm (may be approximately 0.6 mm in some embodiments) and the second minimum distance 226 from the second bore 222 to the small diameter cylindrical portion 214 is at least 1 mm (may be approximately 1.14 mm in some embodiments).

Referring back to FIG. 12, in certain embodiments, the first diameter D210 is approximately 6.4 mm (+/−0.05 mm), the second diameter D212 is approximately 6.2 mm (+/−0.05 mm) and the third diameter D214 is approximately 4.5 mm (+/−0.05 mm), the intermediate diameter cylindrical portion 212 defines a first longitudinal depth L212 that is approximately 1.4 mm (+/−0.1 mm), and the small diameter cylindrical portion 214 defines a second longitudinal depth L214 that is approximately 3.0 mm (+/−0.1 mm).

As shown in FIGS. 7 and 8, an insert 300 may be press fit into the intermediate diameter cylindrical portion 212 and the small diameter cylindrical portion 214 of the counterbore 208 of the fuel injector body 200. Once inserted, this insert 300 may replace the damaged or worn area defining a portion of the rate shaping orifice of the fuel injector body.

Figure 9:
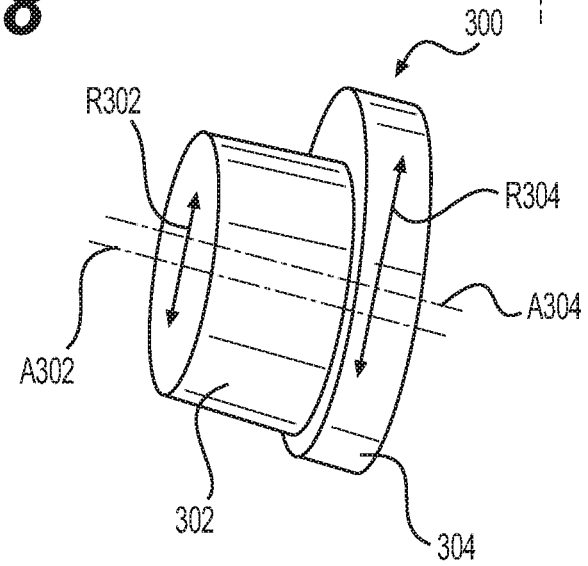
FIG. 9 is a side oriented perspective view of the insert of FIG. 7.
Figure 10:
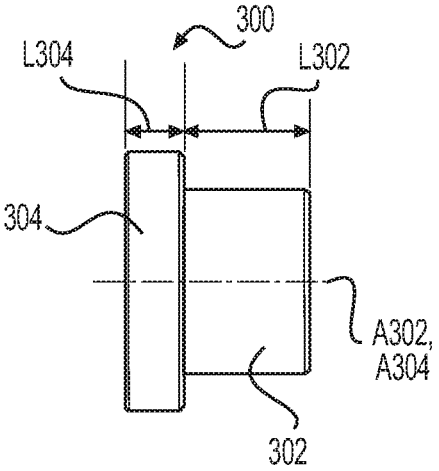
FIG. 10 is a side view of the insert of FIG. 9.
Figure 11:
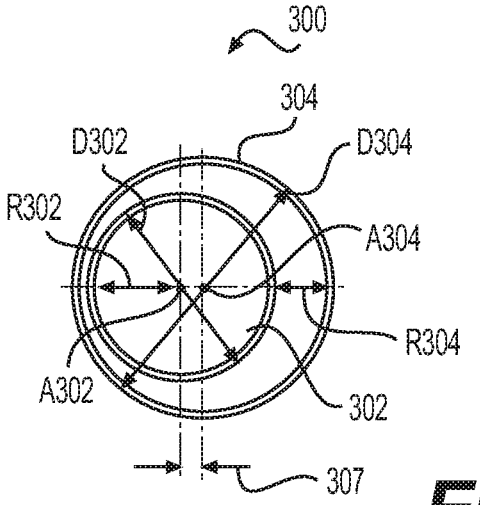
FIG. 11 is a front view of the insert of FIG. 9.

Referring now to FIGS. 9 thru 11, an insert 300 for use with a fuel injector assembly such as that described herein can be seen. In some embodiments, the insert 300 may be used by inserting it such as press fitting it into the counterbore of a fuel injector body after the counterbore has been formed such as by machining using a milling, drilling, electrical discharging machining (EDM) processes, etc. The insert may be retained in the counterbore in other ways.

The insert 300 may comprise a shaft 302 including a substantially cylindrical configuration defining a shaft cylindrical axis A302, a shaft radial direction R302, and a shaft diameter D302. The insert 300 may further comprise a head 304 including a substantially cylindrical configuration defining a head cylindrical axis A304, a head radial direction R304, and a head diameter D304. The shaft 302 and head 304 are attached to each other, the shaft cylindrical axis A302 and the head cylindrical axis A304 are parallel to each other, the head diameter D304 is greater than the shaft diameter D302, and the shaft cylindrical axis A302 is spaced away from the head cylindrical axis A304.

The shaft cylindrical axis A302 may be spaced away from the head cylindrical axis A304 along either the shaft radial direction R302 or the head radial direction R304. For the particular embodiment shown in FIGS. 9 thru 11, the shaft cylindrical axis A302 is spaced away from the head cylindrical axis A304 along both the shaft radial direction R302 and the head radial direction R302 and the insert 300 defines a thru-hole 306 (only shown in FIGS. 7 and 8) that extends radially and longitudinally through the head 304 and the shaft 302. In addition, the shaft cylindrical axis A302 may be spaced away from the head cylindrical axis A304 by a distance 307 of approximately 0.5 mm (+/−0.02 mm). The shaft 302 may define a shaft longitudinal length L302 and the head 304 may define a head longitudinal length L304 and the shaft longitudinal length L302 may be greater than the head longitudinal length L304. The shaft diameter D302 may be approximately 4.5 mm (+/−0.004), the head diameter D304 may be approximately 6.2 mm (+/−0.005), the shaft longitudinal length L302 may be approximately 3.0 mm (+/−0.1 mm) and the head longitudinal length L304 may be approximately 1.4 mm (+/−0.1 mm).

The insert 300 may be inserted into the fuel injector body 200 before the thru-hole 306 is machined into the insert 300 so that the thru-hole 306 is aligned with the first bore 216 of the fuel injector body 200. In other embodiments, the thru-hole 306 may already be machined into the insert 300 before the insert 300 is assembled into the fuel injector body 200. The fuel injector body and the insert may be made from similar materials such as steel.

INDUSTRIAL APPLICABILITY

In practice, an insert, a fuel injector body and/or a fuel injector assembly according to any embodiment described herein may be provided, sold, manufactured, and bought etc. to refurbish, retrofit or remanufacture existing fuel injector assemblies to adjust or repair the injection rate shaping orifice as needed or desired. Similarly, a fuel injector assembly may also be provided, sold, manufactured, and bought, etc. to provide a new fuel injector that includes such an insert, fuel injector body, or fuel injector assembly. The fuel injector assembly, insert, or fuel injector assembly may be new or refurbished, remanufactured, etc.

FIG. 14 is a method for remanufacturing a fuel injector body or designing an insert for use with a fuel injector body according to an embodiment of the present disclosure. The method 400 may comprise: determining at least one of the following: a first minimum desirable distance from a bore of a fuel injector body to a small diameter cylindrical portion of a counterbore of the fuel injector body, and a second minimum desirable distance from a bore of a fuel injector body to a larger diameter cylindrical portion of the counterbore of the fuel injector body (step 402). The method may further comprise designing the configuration of the counterbore so that either the first or second minimum distances are maintained (step 410). Next, the method may further comprise manufacturing a fuel injector body with the desired counterbore geometry and an insert that includes geometry that is at least partially complimentarily configured to match the geometry of the counterbore (step 404), and inserting a valve member into the counterbore proximate an end of the insert (step 406).

In some embodiments, the insert is an insert that is complimentarily shaped to at least part of the geometry of the counterbore is press fit into the counterbore (step 408). In such a case, the insert may include a head that is press fit into the larger diameter cylindrical of the of the counterbore and a shaft that is press fit into the small diameter cylindrical portion of the counterbore (step 412).

Likewise, the cylindrical axis of the small diameter cylindrical portion is spaced radially away from the cylindrical axis of the larger diameter cylindrical portion (see step 414) and/or the small diameter cylindrical portion and larger diameter cylindrical portion do not share the same cylindrical axis (see step 416).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A fuel injector assembly comprising:

a fuel injector component that defines a pressurized fuel chamber;

a check valve assembly in fluid communication with the pressurized fuel chamber;

a plunger disposed in the pressurized fuel chamber; and a fuel injector body that includes an at least partially cylindrical body defining a longitudinal axis, a radial direction, a first end along the longitudinal axis, a second end along the longitudinal axis, and also defining a piston receiving cavity that extends longitudinally from the first end toward the second end terminating short thereof;

a counterbore extending longitudinally from the second end toward the first end and defining a large diameter cylindrical portion proximate the second end, an intermediate diameter cylindrical portion extending longitudinally from the large diameter cylindrical portion toward the first end, and a small diameter cylindrical portion extending longitudinally from the intermediate diameter cylindrical portion toward the first end; and a first bore extending directly from the small diameter cylindrical portion to the piston receiving cavity;

wherein the large diameter cylindrical portion defines a first diameter and a first cylindrical axis, the intermediate diameter cylindrical portion defines a second diameter and a second cylindrical axis, and the small diameter cylindrical portion defines a third diameter and a third cylindrical axis, and the first and second cylindrical axes are collinear and the third cylindrical axis is spaced away from the first and second cylindrical axes, and is parallel to the first and the second cylindrical axes.

2. The fuel injector assembly of claim 1, wherein the counterbore further defines a groove disposed longitudinally between the large diameter cylindrical portion and the intermediate diameter cylindrical portion.

3. The fuel injector assembly of claim 1, wherein the small diameter cylindrical portion defines a bottom, and the first bore extends radially and longitudinally from the bottom of the small diameter cylindrical portion to the piston receiving cavity.

4. The fuel injector assembly of claim 1, wherein the fuel injector body defines a second bore extending from the first end toward the second end and a first minimum distance from the second bore to the intermediate diameter cylindrical portion of the counterbore is at least 0.5 mm and a second minimum distance from the second bore to the small diameter cylindrical portion is at least 1 mm.

5. The fuel injector assembly of claim 4, wherein the first diameter is approximately 6.4 mm, the second diameter is approximately 6.2 mm and the third diameter is approximately 4.5 mm, the intermediate diameter cylindrical portion defines a first longitudinal depth that is approximately 1.4 mm, and the small diameter cylindrical portion defines a second longitudinal depth that is approximately 3.0 mm.

6. The fuel injector assembly of claim 1 further comprising an insert press fit into the intermediate diameter cylindrical portion and the small diameter cylindrical portion of the counterbore.

* * * * *